United States Patent [19]

Harrison

[11] 4,244,493

[45] Jan. 13, 1981

[54] ARRANGEMENT FOR SEALING A BAG CONTAINING PRE-MOISTENED TOWELETTES AND FOR DISPENSING TOWELETTES THEREFROM

[75] Inventor: Thomas S. Harrison, Deer Isle, Me.

[73] Assignee: Sterling Drug Inc., N.Y.

[21] Appl. No.: 950,617

[22] Filed: Oct. 12, 1978

[51] Int. Cl.[3] ..... A47K 10/38

[52] U.S. Cl. ..... 221/46; 206/205; 206/409; 221/63; 225/106

[58] Field of Search ..... 221/44–63; 225/106, 52; 206/205, 389, 395, 396, 397, 409; 220/404; 229/62; 242/55.54

[56] References Cited

U.S. PATENT DOCUMENTS

| | | | |
|---|---|---|---|
| 2,981,990 | 5/1961 | Balderree | 229/62 UX |
| 3,908,822 | 9/1975 | Giberstein | 206/278 |
| 3,986,479 | 10/1976 | Bonk | 221/47 X |
| 3,994,417 | 11/1976 | Boedecker | 221/63 X |

FOREIGN PATENT DOCUMENTS

| | | | |
|---|---|---|---|
| 62902 | 7/1975 | Australia | 220/404 |

*Primary Examiner*—F. J. Bartuska

*Attorney, Agent, or Firm*—Wenderoth, Lind & Ponack

[57] ABSTRACT

A package and dispensing device for a continuous roll of pre-moistened towelettes which has an outer container that holds therein the roll of pre-moistened towelettes, the roll being surrounded by a bag which prevents the roll from drying out. The top of the bag is gathered together and held in a substantially sealed condition by a sealing and dispensing plate with a slit and hole therein, and the towelettes are pulled away from the roll and out of the top of the bag through the hole in the sealing and dispensing plate surrounding the bag.

2 Claims, 4 Drawing Figures

ARRANGEMENT FOR SEALING A BAG CONTAINING PRE-MOISTENED TOWELETTES AND FOR DISPENSING TOWELETTES THEREFROM

BACKGROUND OF THE INVENTION

The present invention relates to a package and a dispensing plate primarily for use in dispensing and separating pre-moistened towels or smaller towelettes from a continuous web of towelling material.

Pre-moistened sheets or towelettes are increasingly popular among consumers because they are convenient and easily provide a "damp cloth" even when water is not readily available. For the most part, these sheets are either individually wrapped or come as part of a continuous web which is rolled and perforated so that it can be separated into a plurality of individual sheets. This invention relates to the dispensing of the sheets or towelettes packaged as a rolled, continuous web.

Presently, rolls of the towelettes are delivered to the consumer in a plastic container with a separable top removably fitted over the container. The top has a specifically designed outlet for withdrawing the towelettes on the roll therethrough and for subsequently separating the individual towelettes from the roll. Novelty among different containers and tops lies primarily in the construction of the opening through which the towelettes are required to pass as they are removed from the roll. The opening must be large enough to permit the towelettes to fit therethrough and, at the same time, must be small enough to exert frictional pull on the towelettes to cause them to separate along the perforated dividing lines.

While the prior art towelette dispensers seem to function well and achieve their goal of separating the individual towelettes from the continuous perforated web, there are drawbacks. The major drawback and area for improvement is the total packaging concept which currently requires expensive materials for forming the package, much hand labor, and, ultimately, disposal of the spent container. The dispenser/containers now available are almost entirely formed from extruded and molded plastics, have a top with the specific type of outlet therethrough positioned on top of the container with the web thereinside, and require that the web be initially fed through the opening so that it is ready to be used. Also, the dispensing opening must be conveniently sealed in some way to prevent the pre-moistened towelettes from drying out before reaching the consumer, and finally, since the containers are of rigid plastic, the disposal of them creates problems — they are bulky even when empty and create polluting fumes when they are burned.

In an effort to eliminate many of the problems which exists with the presently available dispensers and containers, a new package, including a new container and dispensing plate has been developed as shown in FIG. 1. The dispensing package of FIG. 1 utilizes an outer container 100 for holding therein a roll 200 of pre-moistened towelettes. The roll 200 within the container is also surrounded by a bag 300 which helps to prevent the roll from drying out. The top 301 of the bag is opened and folded back inside the outer container 100. The towelettes are pulled away from the roll 200 and out of the top of the bag 301 through the dispensing plate 400.

The outer container 100 may be of any construction which will suitable contain the roll 200. For ease in assembly and disposal, a small paper box which is treated to be moisture resistant is adequate. Thus, a container which is lightweight, yet sturdy, and which will increase the ease of handling and stacking the rolls is provided.

The bag 300 for containing the roll 200 functions primarily to prevent the pre-moistened towelettes from drying out before they reach the consumer and before the consumer uses all of them. To fulfill this function, nearly any lightweight, flexible plastic bag will do; however, any other material which will inhibit vaporization of the moistening liquid in the roll may also be used for the bag and the same results will be obtained.

The actual roll 200 of towelettes is a continuous web 201 which is perforated 202 along the length thereof to form a plurality of sheets or towelettes 203 which can be separated from the remainder of the roll 200 by simply detaching along the perforations. The technique of forming such a roll 200 is old in the art.

Two general embodiments of the sealing and dispensing plate are shown in FIGS. 2 and 3. Each plate 400, 400' has a narrow slit 401, 401' which is directly connected to a hole opening 402, 402'. As shown in FIG. 1, the end of the roll 200 of towelettes is pulled through the narrow slit and then into the hole. The holes 402, 402' are sufficiently large enough to allow the towelettes 203 to be withdrawn from the inside of the bag therethrough. A significant feature of the openings 402, 402', however, is the fact that while the openings must be large enough to allow the towelettes 203 to be withdrawn therethrough, they must, at the same time, provide enough friction to the web so that the towelettes will separate at their perforations 202 as they are pulled through the hole.

The principal distinction between the two plates of FIGS. 2 and 3 is in the construction of the opening space which leads into the slit 401. In FIG. 2, the plate 400 simply has sloping sides 404 leading into the top end 405 of the slit 401; the sloping sides 404 facilitate guiding the end of the towelettes 203 into the slit 401. The variation shown in FIG. 3 discloses a larger hole 406 in the plate 400' at the top end 405' of the slit 401', and the hole 406 has sloping sides 404' at the bottom thereof leading directly into the slit 401'. To use the second embodiment of the plate 400', the towelette 203 is pulled through the hole 406 and then pulled between the sloping sides 404' into the slit 401' and toward the hole 402'. Then, in either embodiment, the towelette 203 is in the smaller hole 402, 402', and the plate 400 remains around the top of the roll 200 with the end towelette thereinside. The plate 400 may have almost any outer edge configuration, i.e., circular, square, polygonal, etc., as long as there is a slit therein with sloping sides leading into it at one end and the slit has a hole at the other end. It is recognized, also, that other variations of the slit construction are also possible.

After the pre-moistened roll 200 of the towelettes is packaged in the bag 300, and the bag is appropriately sealed, such as by heat sealing, the bag then must be cut open or torn at the top by any suitable means by the consumer when it is time to withdraw the towelettes. This assures that the moisture remains in the roll until the towelettes are used. Once the bag 300 is open, the consumer may then easily affix the dispensing plate 400 around the end towelette 203 by pulling the end of the roll of towelettes out of the bag and sliding the towelette 203 along the sloping side 404 of the plate 400 into the slit 401 and the opening 402. The dispensing place 400 is then allowed to rest on top of the roll 200 within the bag.

As effective as this new device is for dispensing the towelettes singly from the roll of towelettes, there is a drawback as clearly shown in FIG. 1. Once the bag is opened and folded back so that the towelettes can be withdrawn therethrough, it exposes the roll of towelettes to the atmosphere. Even though the container which houses these towelettes is designed to be moisture impervious, because the seal of the bag is broken, the towelettes are susceptible to drying out much more rapidly than in the other prior art devices where the roll of towelettes is dispensed through only a single substantially closed opening in the container itself rather than by means of a dispensing plate as discussed herein.

SUMMARY OF THE INVENTION

It is, therefore, an object of the present invention to provide an arrangement for the sealing and dispensing plate which will prevent the roll of pre-moistened towelettes from drying out during use while permitting the towelettes to be withdrawn therethrough and separated from the continuous roll of individual towelettes.

The object of this invention is achieved by providing a moisture-proof container which contains a pre-moistened roll of towelettes thereinside with a moisture-proof bag. A special dispensing plate with a slit and a hole therein fits around the open top of the bag while the end sheet of a roll of towelettes projects through the top of the bag. The top of the bag and the towelettes slide through the slit into the hole, thereby substantially sealing the bag around the roll by gathering the bag closely together within the hole. The hole, however, is still large enough to allow the towelettes to be withdrawn therethrough and separated from each other.

BRIEF DESCRIPTION OF THE DRAWINGS

Further objects and a better understanding of the novel features of the present invention will become apparent from the following detailed description taken with the drawings, wherein.

DETAILED DESCRIPTION OF THE INVENTION

Figure 1:
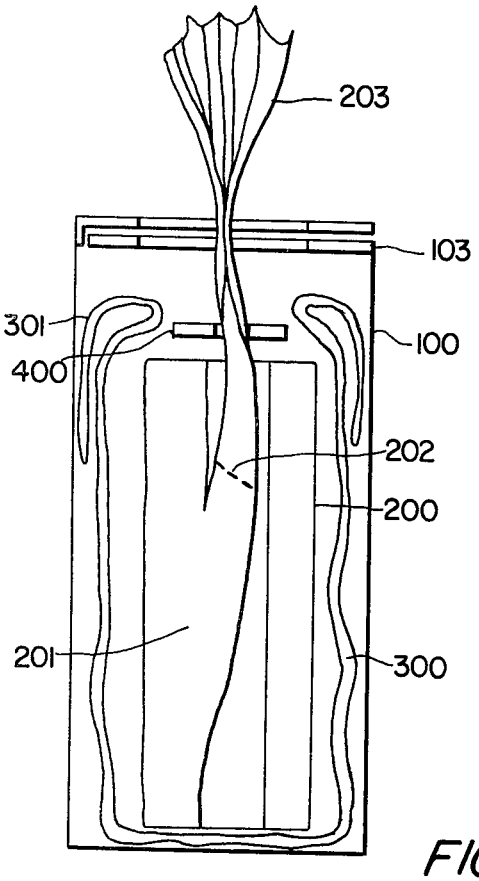
FIG. 1 PRIOR ART
FIG. 1 is a section view of a prior art dispensing container.
Figure 4:
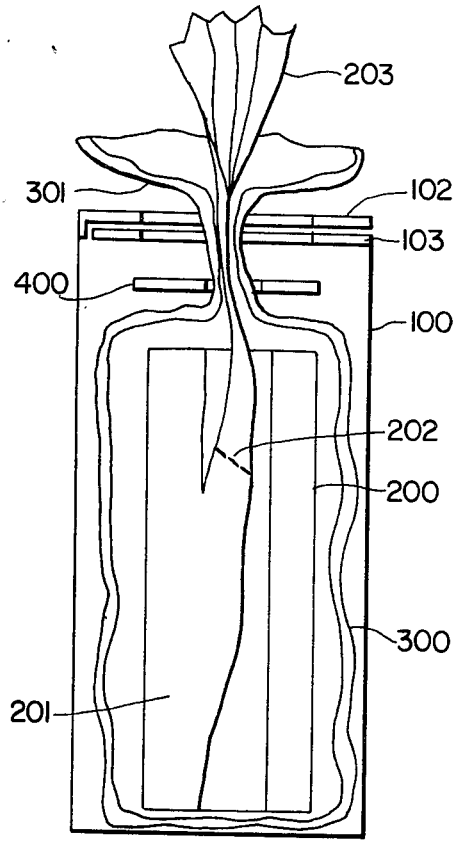
FIG. 4 is a section view of an embodiment of the present invention.
Figure 3:
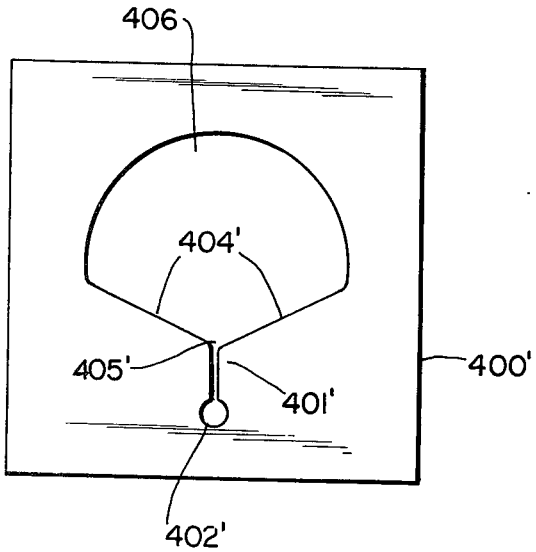
FIG. 3 PRIOR ART
FIGS. 2 and 3 are top views of different embodiments of a prior art sealing and dispensing plate which may be used in this invention.
Figure 2:
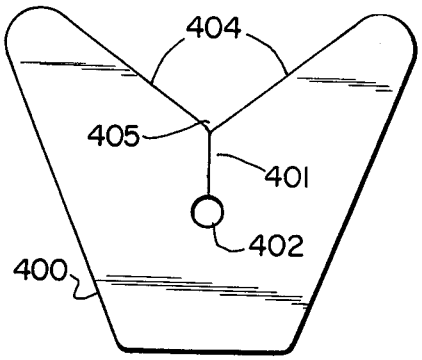
FIG. 2 PRIOR ART

The present invention is represented by the embodiment disclosed in FIG. 4. As shown therein, unlike the prior art embodiment shown in FIG. 1, the present invention provides for a dispensing plate 400 which will slide around and contain therein both the towelette 203 as well as the top end 301 of the plastic bag 300 surrounding the roll of pre-moistened towelettes. It has been found that by only slightly enlarging the opening 402 in the dispensing plate that both the bag and the towelettes can be effectively held in a sealing relationship, but at the same time being loose enough to allow the towelette to be withdrawn through the hole 402. Like the prior art embodiment, the dispensing plate still must be tight enough around the towelette, with the bag thereinbetween, to exert friction on the towelette so that it will separate along the perforation 202.

In a manner similar to that pointed out for the prior art arrangement for dispensing the towelettes, when the pre-moistened roll 200 of the towelettes is packaged in the bag 300, the bag may be appropriately sealed, such as by heat sealing and then the bag must be torn or cut open at the top by any suitable means by the consumer when it is ready to be used — thus assuring that the moisture remains in the bag until the towelettes are used. Once the bag 300 is open, the consumer may then easily affix the dispensing plate 400 around both the top 301 of the bag and the towelette 203 by pulling the end of the roll of towelettes out of the bag and sliding both the top 301 of the bag and the towelettes 203 along the sloping sides 404 of the plate 400 into the slit 401 and the hole 402.

Such a construction with the bag also being held within the dispensing hole along with the towelette greatly enhances the useful life of the pre-moistened towelettes since the bag is effectively sealed around the towelettes making it impossible for the moisture to escape therefrom. Also, this arrangement also makes it quite easy for rethreading the towelettes through the dispensing plate if, by accident, one of the towelettes should tear at the perforation before the next succeeding sheet is withdrawn through the opening 402. The user needs only to remove the plate 400 from around the bag and the towelettes, grab the next towelette and pull it upward through the bag, and then replace the dispensing plate around the bag and the extended towelette.

Any of the embodiments of the dispensing plate which were taught by the prior art references may be used in this instance and the apparatus will still fork efficiently.

It is recognized that further embodiments and modifications of the above-described invention are possible within the scope of this invention, and therefore, it is not intended that the invention be limited to those embodiments specifically presented herein.

What is claimed is:

1. A package for dispensing and separating single sheets from a continuous roll of pre-moistened sheets which are joined at perforations, said package comprising:

container means for housing therein a continuous roll of pre-moistened sheets;

bag means positioned within said container means and surrounding said roll, said bag means being open at a top end portion thereof and an end sheet of said roll extending therethrough; and dispensing plate means, separate from and positioned within said container means, surrounding said end sheet of said roll and said top end portion of said bag means for gathering and substantially sealing said bag means around said end sheet of said roll and for dispensing said end sheet therethrough and causing said end sheet to tear from the next sheet on said roll at the perforations when said end sheet is drawn therethrough.

2. In a package for dispensing and separating single sheets from a continuous roll of pre-moistened sheets which are joined at perforations, which package has:

container means for housing said roll therein;

bag means positioned within said container means and surrouding said roll, said bag means being open at a top end portion thereof and an end sheet of said roll extending therethrough; and dispensing plate means, separate from and positioned within said container means, surrounding said end sheet of said roll for dispensing said end sheet therethrough and causing said end sheet to tear from the next sheet on said roll at the perforations when said end sheet is drawn therethrough;

an improvement comprising:

said dispensing plate means further surrounding and gathering said bag means at said top end portion thereof around said end sheet for substantially closing said bag means around said end sheet, whereby said sheets remaining on said roll within said bag means are substantially sealed therein.

* * * * *